US009874322B2

(12) United States Patent
Edmond et al.

(10) Patent No.: US 9,874,322 B2
(45) Date of Patent: Jan. 23, 2018

(54) LENSED TROFFER-STYLE LIGHT FIXTURE

(75) Inventors: Mark D. Edmond, Raleigh, NC (US); Paul Kenneth Pickard, Morrisville, NC (US)

(73) Assignee: CREE, INC., Durham, NC (US)

( * ) Notice: Subject to any disclaimer, the term of this patent is extended or adjusted under 35 U.S.C. 154(b) by 567 days.

(21) Appl. No.: 13/443,630

(22) Filed: Apr. 10, 2012

(65) Prior Publication Data

US 2013/0265751 A1 Oct. 10, 2013

(51) Int. Cl.

| | |
|---|---|
| ***F21S 8/02*** | (2006.01) |
| ***F21S 8/04*** | (2006.01) |
| ***F21V 3/04*** | (2006.01) |
| *F21V 5/00* | (2015.01) |
| *F21V 7/00* | (2006.01) |
| *F21Y 105/10* | (2016.01) |

(Continued)

(52) U.S. Cl.

CPC ..... *F21S 8/026* (2013.01); *F21S 8/04* (2013.01); *F21V 3/049* (2013.01); *F21V 5/008* (2013.01); *F21V 7/005* (2013.01); *F21V 7/0083* (2013.01); *F21Y 2103/10* (2016.08); *F21Y 2105/10* (2016.08); *F21Y 2115/10* (2016.08)

(58) Field of Classification Search

CPC ..... F21Y 2101/02; F21Y 2103/003; F21Y 2113/005; F21Y 2103/00; F21S 8/026; F21S 8/04; F21V 3/049

See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 362/223 |
| 3,381,124 | A | 4/1968 | Eisenberg | 362/354 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

Preliminary Report and Written Opinion from PCT appl. No. PCT/US2012/047084, dated Feb. 6, 2014.

(Continued)

*Primary Examiner* — Anne Hines

(74) *Attorney, Agent, or Firm* — Koppel, Patrick, Heybl & Philpott

(57) ABSTRACT

Troffer-style lighting fixtures are disclosed having troffer housing with reflective regions, and respective light emitting diode (LED) arrays mounted in the reflective regions. The LED arrays are arranged to emit out of said troffer housing to illuminate a room below. The LED arrays can be driven by an elevated drive signal to produce a high luminous flux. The light fixtures according to the present invention can have lenses and diffusers over the arrays arranged to mix and disperse light from the light source to reduce hot spots and the appearance of individual LED colors. A plurality of first diffusers is included, each over a respective LED array. A second diffuser is included over the first diffusers, with the LED light passing through the diffusers prior to emitting from the lighting fixture. The diffusers can have shapes, surfaces or materials to disperse and/or mix the LED light as it emits.

37 Claims, 5 Drawing Sheets

(51) Int. Cl.
*F21Y 103/10* (2016.01)
*F21Y 115/10* (2016.01)

(56) References Cited

U.S. PATENT DOCUMENTS 3,743,826 A * 7/1973 Halfaker ..... E04B 9/00 362/149
4,939,627 A 7/1990 Herst et al. ..... 362/299
5,025,356 A 6/1991 Gawad ..... 362/221
5,526,190 A 6/1996 Hubble, III ..... 347/102
5,823,663 A 10/1998 Bell et al. ..... 362/362
D407,473 S 3/1999 Wimbock ..... D23/328
6,079,851 A 6/2000 Altman
6,102,550 A 8/2000 Edward, Jr.
6,149,283 A 11/2000 Conway et al. ..... 362/236
6,155,699 A 12/2000 Miller et al. ..... 362/293
6,210,025 B1 4/2001 Schmidt et al. ..... 362/362
6,234,643 B1 5/2001 Lichon, Jr. ..... 362/147
6,402,347 B1 6/2002 Maas et al. ..... 362/294
6,443,598 B1 9/2002 Morgan ..... 362/342
6,523,974 B2 2/2003 Engel ..... 362/224
6,578,979 B2 6/2003 Truttmann-Battig ..... 362/92
6,598,998 B2 7/2003 West ..... 257/E33.073
D496,121 S 9/2004 Santoro ..... D26/74
6,871,983 B2 3/2005 Jacob et al. ..... 362/364
6,948,838 B2 9/2005 Kunstler ..... 362/237
6,948,840 B2 9/2005 Grenda et al. ..... 362/555
6,951,415 B2 10/2005 Amano ..... 362/297
7,021,797 B2 4/2006 Minano et al. ..... 362/355
7,049,761 B2 5/2006 Timmermans et al. ..... 315/246
7,063,449 B2 6/2006 Ward ..... 345/102
7,111,969 B2 9/2006 Bottesch ..... 362/299
7,175,296 B2 2/2007 Cok ..... 362/147
7,213,940 B1 5/2007 Van de Ven et al. ..... 362/231
7,217,004 B2 5/2007 Park et al. ..... 362/240
7,237,924 B2 7/2007 Martineau et al. ..... 362/231
D556,358 S 11/2007 Santoro ..... D26/74
7,338,182 B1 3/2008 Hastings et al. ..... 362/150
7,341,358 B2 3/2008 Hsieh ..... 362/97.1
7,510,299 B2 3/2009 Timmermans et al. ..... 362/225
7,520,636 B2 4/2009 Van der Poel ..... 362/290
D593,246 S 5/2009 Fowler et al. ..... D26/76
7,559,672 B1 7/2009 Parkyn et al. ..... 362/244
7,594,736 B1 9/2009 Kassay et al. ..... 362/223
D604,446 S 11/2009 Fowler et al. ..... D26/76
7,618,157 B1 11/2009 Galvez et al. ..... 362/294
7,618,160 B2 11/2009 Chinniah et al. ..... 362/326
D608,932 S 1/2010 Castelli ..... D26/76
7,654,688 B2 2/2010 Li
7,654,702 B1 2/2010 Ding et al. ..... 362/294
7,661,844 B2 2/2010 Sekiguchi et al. ..... 362/249
D611,183 S 3/2010 Duarte ..... D26/76
7,674,005 B2 3/2010 Chung et al. ..... 362/223
7,686,470 B2 3/2010 Chiang ..... 362/147
7,686,484 B2 3/2010 Heiking et al. ..... 362/375
7,712,918 B2 5/2010 Siemiet et al. ..... 362/241
7,722,220 B2 5/2010 Van de Ven ..... 362/294
7,722,227 B2 5/2010 Zhang et al. ..... 362/364
D617,487 S 6/2010 Fowler et al. ..... D26/76
7,768,192 B2 8/2010 Van de Ven et al. ..... 313/503
7,815,338 B2 10/2010 Siemiet et al. ..... 362/218
7,824,056 B2 11/2010 Madireddi et al. ..... 362/125
7,828,468 B2 11/2010 Mayfield et al. ..... 362/342
7,868,484 B2 1/2011 Groff et al. ..... 362/375
D633,247 S 2/2011 Kong et al. ..... D26/88
7,887,216 B2 2/2011 Patrick et al.
7,922,354 B2 4/2011 Everhart ..... 362/235
7,926,982 B2 4/2011 Liu ..... 362/294
7,959,332 B2 6/2011 Tickner
7,988,321 B2 8/2011 Wung et al. ..... 362/218
7,988,335 B2 8/2011 Liu et al. ..... 362/294
7,991,257 B1 8/2011 Coleman ..... 264/1.24
7,993,034 B2 8/2011 Wegner ..... 362/296.05
7,997,762 B2 8/2011 Wang et al. ..... 362/249
8,038,314 B2 10/2011 Ladewig
8,038,321 B1 10/2011 Franck et al. ..... 362/249.02
8,070,326 B2 12/2011 Lee ..... 362/307
D653,376 S 1/2012 Kong et al. ..... D26/76
8,092,043 B2 1/2012 Lin et al. ..... 362/249.02
8,092,049 B2 1/2012 Kinnune et al. ..... 362/294
8,096,671 B1 1/2012 Cronk ..... 362/147
D657,488 S 4/2012 Lown et al. ..... D26/120
8,162,504 B2 4/2012 Zhang et al. ..... 362/217
8,186,855 B2 5/2012 Wassel et al. ..... 362/373
8,197,086 B2 6/2012 Watanabe et al. ..... 362/218
8,201,968 B2 6/2012 Maxik et al.
8,215,799 B2 7/2012 Vanden Eynden et al. .. 362/294
8,246,219 B2 8/2012 Teng et al. ..... 362/311.03
8,256,927 B2 9/2012 Hu et al. ..... 362/294
8,287,160 B2 10/2012 Shen
D670,849 S 11/2012 Lay et al. ..... D26/74
8,317,354 B2 11/2012 Gassner et al. ..... 362/147
D676,848 S 2/2013 Pickard et al. ..... D26/74
8,410,514 B2 4/2013 Kim ..... 257/99
D684,291 S 6/2013 Goelz et al. ..... D26/74
8,480,252 B2 7/2013 Bertram et al. ..... 362/243
8,506,135 B1 8/2013 Oster ..... 362/373
8,556,452 B2 10/2013 Simon ..... 362/217.07
8,591,058 B2 11/2013 Concepcion ..... 362/231
8,591,071 B2 11/2013 Hochstein ..... 362/294
8,602,601 B2 12/2013 Khazi
8,616,723 B2 12/2013 Zhang ..... 362/218
D698,975 S 2/2014 Blessitt et al. ..... D26/74
8,641,243 B1 2/2014 Rashidi ..... 362/373
D701,988 S 4/2014 Clements ..... D26/74
8,696,154 B2 4/2014 Hutchens ..... 362/217.05
8,702,264 B1 4/2014 Rashidi ..... 362/147
8,764,244 B2 7/2014 Jeon ..... 362/218
D714,988 S 10/2014 Park et al. ..... D26/74
D721,198 S 1/2015 Glasbrenner ..... D26/76
9,010,956 B1 4/2015 Davis
9,052,075 B2 6/2015 Demuynck et al.
2003/0063476 A1 4/2003 English et al.
2004/0001344 A1 1/2004 Hecht ..... 362/555
2004/0085779 A1 5/2004 Pond et al. ..... 362/516
2004/0100796 A1 5/2004 Ward
2004/0240230 A1 12/2004 Kitajima ..... 362/558
2005/0180135 A1 8/2005 Mayer ..... 362/240
2005/0264716 A1 12/2005 Kim et al.
2005/0281023 A1 12/2005 Gould ..... 362/217
2006/0221611 A1 10/2006 Noh ..... 362/247
2006/0262521 A1 11/2006 Piepgras et al. ..... 362/149
2006/0291206 A1 12/2006 Angelini et al. ..... 362/244
2007/0070625 A1 3/2007 Bang ..... 362/240
2007/0109779 A1 5/2007 Sekiguchi et al.
2007/0115670 A1 5/2007 Roberts et al.
2007/0115671 A1 5/2007 Roberts et al.
2007/0211457 A1 9/2007 Mayfield et al. ..... 362/223
2007/0253205 A1 11/2007 Welker ..... 362/373
2007/0297181 A1 12/2007 Mayfield et al. ..... 362/342
2008/0019147 A1 1/2008 Erchak ..... 362/607
2008/0037284 A1 2/2008 Rudisill ..... 362/629
2008/0049422 A1 2/2008 Trenchard et al. ..... 362/238
2008/0232093 A1 9/2008 Kim ..... 362/147
2008/0278943 A1 11/2008 Van der Poel ..... 362/240
2009/0034247 A1 2/2009 Boyer ..... 362/225
2009/0073693 A1 3/2009 Nall ..... 362/249.02
2009/0161356 A1 6/2009 Negley et al. ..... 362/231
2009/0168439 A1 7/2009 Chiang ..... 362/404
2009/0196024 A1 8/2009 Heiking et al. ..... 362/150
2009/0225543 A1 9/2009 Roberts et al.
2009/0237958 A1 9/2009 Kim
2009/0262543 A1 10/2009 Ho ..... 362/373
2009/0296388 A1 12/2009 Wu et al. ..... 362/235
2009/0310354 A1 12/2009 Zampini et al. ..... 362/235
2009/0323334 A1 12/2009 Roberts et al.
2010/0061108 A1 3/2010 Zhang et al. ..... 362/364
2010/0097794 A1 4/2010 Teng et al. ..... 362/231
2010/0103678 A1 4/2010 Van de Ven et al. ..... 362/294
2010/0110679 A1 5/2010 Teng et al.
2010/0172133 A1 7/2010 Lie ..... 362/235
2010/0177532 A1 7/2010 Simon et al. ..... 362/555
2010/0188609 A1 7/2010 Matsuki et al.
2010/0253591 A1 10/2010 Hwu et al. ..... 345/1.3

(56) References Cited

U.S. PATENT DOCUMENTS

| | | | | |
|---|---|---|---|---|
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1* | 6/2011 | Kim | 315/32 |
| 2011/0164417 | A1 | 7/2011 | Huang | 362/235 |
| 2011/0175533 | A1 | 7/2011 | Holman | 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0286225 | A1 | 11/2011 | Konishi | |
| 2011/0305024 | A1 | 12/2011 | Chang | 362/294 |
| 2012/0033420 | A1 | 2/2012 | Kim et al. | 362/235 |
| 2012/0038289 | A1* | 2/2012 | Jee et al. | 315/291 |
| 2012/0051041 | A1* | 3/2012 | Edmond et al. | 362/231 |
| 2012/0120658 | A1 | 5/2012 | Wilk | |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Pickard | |
| 2012/0206926 | A9 | 8/2012 | Chou | |
| 2013/0235568 | A1 | 9/2013 | Green et al. | 362/218 |
| 2013/0242550 | A1* | 9/2013 | Suen | F21K 9/56 362/235 |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/233 |

FOREIGN PATENT DOCUMENTS

| | | | |
|---|---|---|---|
| CN | 1963289 | A | 5/2007 |
| CN | 101188261 | | 5/2008 |
| CN | 101660715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| CN | 202580962 | | 12/2012 |
| DE | 102007030186 | | 1/2009 |
| DE | 202010001832 | | 7/2010 |
| EP | 1298383 | | 4/2003 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | | 10/2007 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO 03102467 | | 12/2003 |
| WO | WO 2009030233 | | 3/2009 |
| WO | 2009140761 | A1 | 11/2009 |
| WO | WO 2009157999 | | 12/2009 |
| WO | WO 2009157999 | A | 12/2009 |
| WO | WO 2009157999 | A1 | 12/2009 |
| WO | WO 2010024583 | | 3/2010 |
| WO | WO 2010024583 | A2 | 3/2010 |
| WO | WO 2010042216 | | 4/2010 |
| WO | WO 2010042216 | A2 | 4/2010 |
| WO | 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |
| WO | WO 03102467 | | 12/2013 |

OTHER PUBLICATIONS

Search Report and Written Opinion from PCT Patent Appl. No. PCT/US2012/047084, dated Feb. 27, 2013.

Search Report and Written Opinion from PCT Patent Appl. No. PCT/US2012/071800, dated Mar. 25, 2013.

U.S. Appl. No. 12/873,303, filed Aug. 31, 2010 to Edmond, et al.

U.S. Appl. No. 12/961,385, filed Dec. 6, 2010 to Pickard, et al.

Cree's XLamp XP-E LED's, data sheet, pp. 1-16.

Cree's XLamp XP-G LED's, data sheet, pp. 1-12.

International Search Report and Written Opinion for Patent Application No. PCT/US2011/001517, dated Feb. 27, 2012.

Office Action from U.S. Appl. No. 13/429,080, dated Apr. 18, 2014.

Office Action from U.S. Appl. No. 12/961,385, dated Mar. 11, 2014.

Office Action from Japanese Design Patent Application No. 2011-18570.

Reason for Rejection from Japanese Design Patent Application No. 2011-18571.

Reason for Rejection from Japanese Design Patent Application No. 2011-18572.

International Search Report and Written Opinion from PCT Application No. PCT/US2013/021053, dated Apr. 17, 2013.

Final Rejection issued in Korean Design Appl. No. 30-2011-0038114, dated Jun. 14, 2013.

Final Rejection issued in Korean Design Appl. No. 30-2011-0038115, dated Jun. 14, 2013.

Final Rejection issued in Korean Design Appl. No. 30-2011-0038116, dated Jun. 17, 2013.

International Search Report and Written Opinion from PCT Patent Appl. No. PCT/US2013/035668, dated Jul. 12, 2013.

Office Action from U.S. Appl. No. 29/387,171, dated May 2, 2012.

Response to OA from U.S. Appl. No. 29/387,171, filed Aug. 2, 2012.

Office Action from U.S. Appl. No. 12/961,385, dated Apr. 26, 2013.

Response to OA from U.S. Appl. No. 12/961,385, filed Jul. 24, 2013.

Office Action from U.S. Appl. No. 13/464,745, dated Jul. 16, 2013.

Office Action from U.S. Appl. No. 29/368,970, dated Jun. 19, 2012.

Office Action from U.S. Appl. No. 29/368,970, dated Aug. 24, 2012.

Response to OA from U.S. Appl. No. 29/368,970, filed Nov. 26, 2012.

International Search Report and Written Opinion from PCT/US2013/049225, dated Oct. 24, 2013.

Office Action from U.S. Appl. No. 13/464,745, dated Feb. 12, 2014.

Office Action from U.S. Appl. No. 13/453,924, dated Feb. 19, 2014.

Office Action from U.S. Appl. No. 13/341,741, dated Jan. 14, 2014.

(56) References Cited

OTHER PUBLICATIONS

Office Action from U.S. Appl. No. 13/370,252, dated Dec. 20, 2013.
International Search Report and Written Opinion from Appl. No. PCT/CN2013/072772, dated Dec. 19, 2013.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
First Official Action from European Patent Appl. No. 12 743 003.1-1757, dated Jan. 16, 2015.
Office Action from U.S. Appl. No. 13/767,727, dated Jan. 29, 2015.
Office Action from U.S. Appl. No. 13/429,080, dated Feb. 18, 2015.
Office Action from U.S. Appl. No. 13/453,924, dated Mar. 10, 2015.
Office Action from U.S. Appl. No. 13/464,745, dated Jul. 16, 2014.
International Preliminary Report on Patentability and Written Opinion from PCT/US2013/021053, dated Aug. 21, 2014.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
International Search Report and Written Opinion for PCT Application No. PCT/US2011/062396, dated Jul. 13, 2012.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; dated Jan. 6, 2016.
Office Action from U.S. Appl. No. 13/341,741; dated Jan. 8, 2016.
Office Action from U.S. Appl. No. 13/873,303; dated Feb. 2, 2016.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
Office Action from U.S. Appl. No. 13/464,745; dated Mar. 1, 2016.
Office Action from U.S. Appl. No. 14/716,480; dated Mar. 3, 2016.
Office Action from U.S. Appl. No. 13/368,217; dated Mar. 4, 2016.
Office Action from U.S. Appl. No. 13/189,535; dated Mar. 18, 2016.
Office Action from U.S. Appl. No. 14/020,757; dated Apr. 7, 2016.
Office Action from U.S. Appl. No. 29/466,391; dated May 10, 2016.
Second Office Action for Application No. 2011800588770; dated Mar. 29, 2016.
Office Action for U.S. Appl. No. 13/828,348; dated Jun. 2, 2016.
Notice of Reason for Rejection for Japanese Appl. No. 2013-543207; dated May 24, 2016.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12,873,303, filed Aug. 21, 2015.
Office Action from U.S. Appl. No. 13/341,741, dated Jun. 22, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Office Action for U.S. Appl. No. 14/020,757; dated Jul. 19, 2016.
Examination Report from Taiwan Application No. 100131021; dated Jul. 21, 2016.
Office Action for U.S. Appl. No. 14/716,480; dated Aug. 26, 2016.
European Summons for Oral Proceedings for Application No. 12743003.1; Dated Sep. 2, 2016.
Office Action for U.S. Appl. No. 13/464,745; dated Sep. 7, 2016.
Office Action for Chinese Patent Application No. 2011800588770; dated Sep. 26, 2016.
Notification of Reexamination for Chinese Application No. 2011800529984; dated Oct. 10, 2016.
Office Action for U.S. Appl. No. 13/828,348; dated Oct. 17, 2016.
Office Action for European Application No. 11754767.9; dated Oct. 31, 2016.
Office Action for U.S. Appl. No. 12/873,303; dated Nov. 25, 2016.
Notice of Allowance for Taiwan Application No. 100131021; dated Nov. 28, 2016.
Office Action for U.S. Appl. No. 13/368,217; dated Jan. 3, 2017.
Communication from European Patent Appl. No. 13701525.1-1757, dated Sep. 26, 2014.
First Office Action from Chinese Patent Appl. No. 201280369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Office Action for U.S. Appl. No. 14/716,480; dated Feb. 8, 2017.
Foreign Office Action for Japanese Application No. 2013-543207; dated Feb. 14, 2017.
Office Action for U.S. Appl. No. 14/225,327; dated Mar. 14, 2017.
European Notice of Allowance for Application No. 12743003.1; dated Mar. 17, 2017.
Office Action for U.S. Appl. No. 13/189,535; dated Mar. 23, 2017.
Office Action for U.S. Appl. No. 13/464,745; dated Mar. 23, 2017.
Foreign Office Action for Chinese Application No. 2011800529984; dated Apr. 5, 2017.
Office Action for U.S. Appl. No. 14/721,806; dated Apr. 21, 2017.
International Preliminary Report on Patentabliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action for U.S. Appl. No. 14/170,627; dated Jun. 16, 2017.
Office Action for U.S. Appl. No. 14/716,480; dated Jul. 5, 2017.
Office Action for U.S. Appl. No. 12/873,303; dated Aug. 9, 2017.
Office Action for U.S. Appl. No. 13/828,348; dated Sep. 1, 2017.
Office Action for U.S. Appl. No. 14/225,327; dated Oct. 2, 2017.

(56) References Cited

OTHER PUBLICATIONS

Office Action for U.S. Appl. No. 13/189,535; dated Oct. 30, 2017.
Office Action for U.S. Appl. No. 14/721,806; dated Nov. 1, 2017.
Office Action for U.S. Appl. No. 14/170,627; dated Nov. 29, 2017.

* cited by examiner

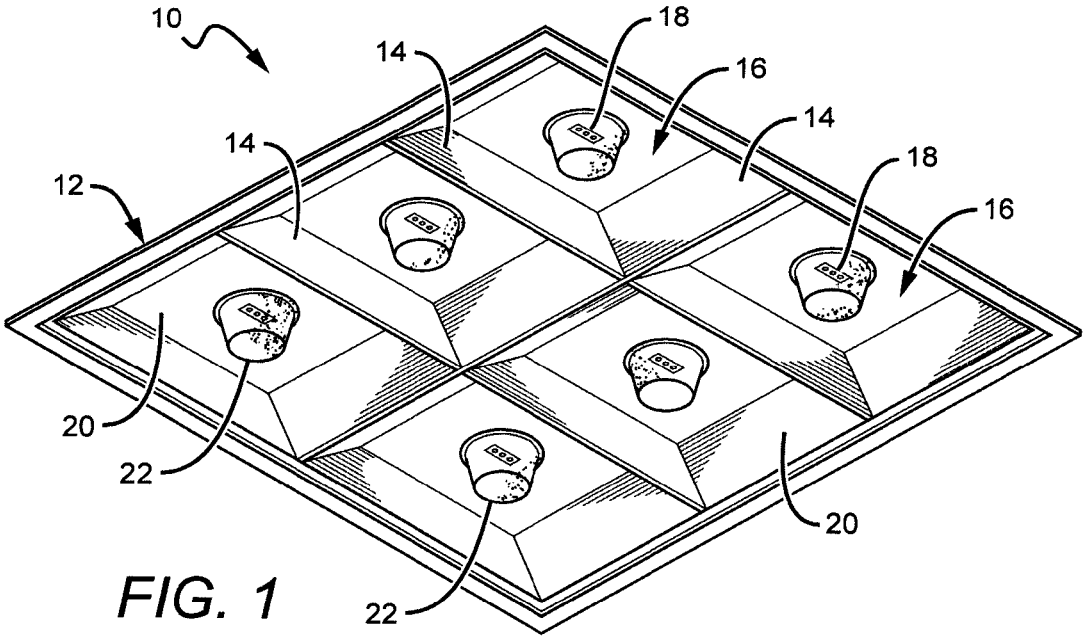
FIG. 1
FIG. 2
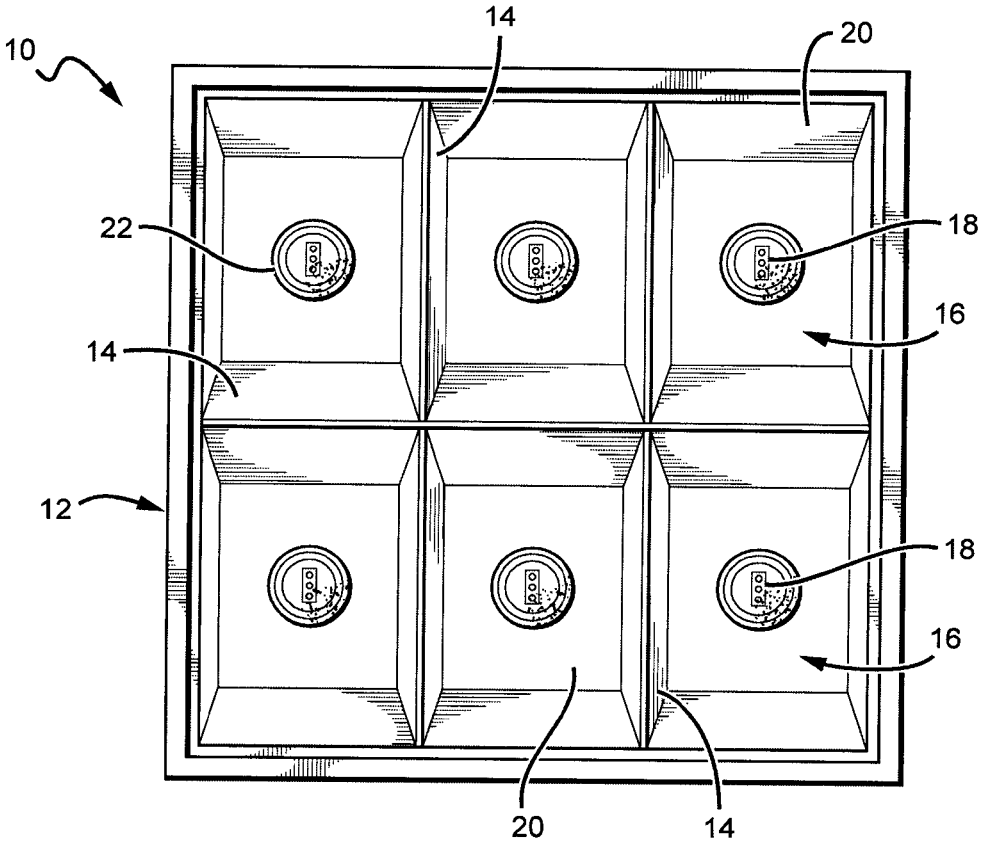

LENSED TROFFER-STYLE LIGHT FIXTURE

BACKGROUND OF THE INVENTION

Field of the Invention

The invention relates to troffer-style lighting fixtures, and more particularly, to troffer-style lighting fixtures utilizing lenses, dispersers and/or diffusers to disperse and mix light from the light source.

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings, such as being suspended by a "T-grid". Often the troffer may be recessed into the ceiling, with the back side of the troffer (i.e. troffer pan) protruding into the plenum area above the ceiling a distance of up to six inches or more. In other arrangements, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures. These fixtures can require a significant amount of ceiling space to operate properly.

More recently, with the advent of the efficient solid state lighting sources, these troffers have been used with solid state light sources, such as light emitting diodes (LEDs). LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color emission. In comparison, LEDs can have lifetimes between 50,000 and 70,000 hours. The increased efficiency and extended lifetime of LEDs is attractive to many lighting suppliers and has resulted in LED light sources being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Because of the physical arrangement of the various source elements, multicolor sources often cast shadows with color separation and provide an output with poor color uniformity. Thus, one challenge associated with multicolor light sources is good spatial color mixing over the entire range of viewing angles. One known approach to the problem of color mixing is to use a diffuser to scatter light from the various sources.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated light sources or light engines utilizing an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to van de Ven which is commonly assigned with the present application.

There have also been recent designs that focus more on retrofitting or redesigning existing troffer-style light fixtures so that they utilize LEDs at their light source. This can allow manufacturers to use existing manufacturing capabilities to produce troffer housings for LEDs, which is thought to help in reducing overall troffer costs. In some of these fixtures, hundreds of LED packages are mounted to the surface of an existing troffer pan to essentially cover the troffer pan surface with emitters. In some of these up to 400 LED packages can be utilized. The emitters are then driven with a relatively low electrical signal in the hopes that the fixture would give the relatively even emission light fixture with no visible hot spots.

Troffer-style light fixtures are typically provided with a prismatic lens or diffuser over the troffer pan/housing opening that faces the room to be illuminated. The prismatic diffuser is included to disperse some of the light from the troffer fixture's light source. Despite the use of hundreds of LED packages in an effort to spread the light source, these LED fixtures can still exhibit multiple emission hot spots as the light passes through the prismatic diffuser. These hot spots can be undesirable to the end user. These fixtures having hundreds of LED packages can be relatively expensive, with the bulk of the expense being the LED packages, along with the cost and complexity of mounting, interconnecting and driving the LED packages.

SUMMARY OF THE INVENTION

The present invention is directed to lighting fixtures utilizing a plurality of light sources, or light engines, mounted in a lighting fixture with lenses or diffusers to provide the desired fixture emission. The present invention is particularly applicable to troffer-style lighting fixtures having light sources mounted to the surface of troffer pan/housing ("troffer housing") and emitting out the troffer opening. Some of the light sources can comprise LED arrays mounted in intervals to the surface of the troffer pan, with some of the arrays having different colors of LEDs that combine to emit the desired array and fixture emission. The light sources can comprise LEDs driven by an elevated drive signal to produce a relatively high luminous flux. The light fixtures according to the present invention can have lenses and diffusers over the arrays arranged to mix and disperse light from the light source to reduce or eliminate hot spots and to reduce or eliminate the appearance of the different LED colors.

One embodiment of a light fixture according to the present invention comprises a fixture housing having a fixture opening. A plurality of LED arrays are mounted to the fixture housing and emit out the fixture opening. A plurality of first diffusers are included each of which is over a respective one of said LED arrays. Each of the diffusers disperses and/or mixing light from its LED array. At least one second diffuser is also included and is arranged so that light from at least one of the LED arrays passes through the second diffuser after passing through its one of the first diffusers.

Another embodiment of a light fixture according to the present invention comprises a fixture housing having a fixture opening. A plurality of solid state light sources are mounted to the fixture housing and emit out of the fixture opening. A plurality of diffusers are also included with the light from the LED arrays passing through the plurality of diffusers prior to emitting from said fixture housing. The diffusers disperse and/or mixing light from the solid state light sources.

One embodiment of a troffer-style light fixture according to the present invention comprises a troffer housing having a plurality of reflective regions. A plurality of white emitting LED light sources are included, a respective one of which is mounted in one of the reflective regions. A plurality of first diffusers is included each of which is over a respective one of the LED light sources. A second diffuser is included over the first diffusers, the diffusers are arranged so that light emitting from said fixture passes through the first and second diffusers for dispersing and/or mixing.

These and other aspects and advantages of the invention will become apparent from the following detailed description and the accompanying drawings which illustrate by way of example the features of the invention.

BRIEF DESCRIPTION OF THE DRAWINGS

FIG. 1 is a perspective view of one embodiment of lighting fixtures according to an embodiment of the present invention.

FIG. 2 is a top view of the lighting fixture shown in FIG. 1;

DETAILED DESCRIPTION OF THE INVENTION

Figure 3:
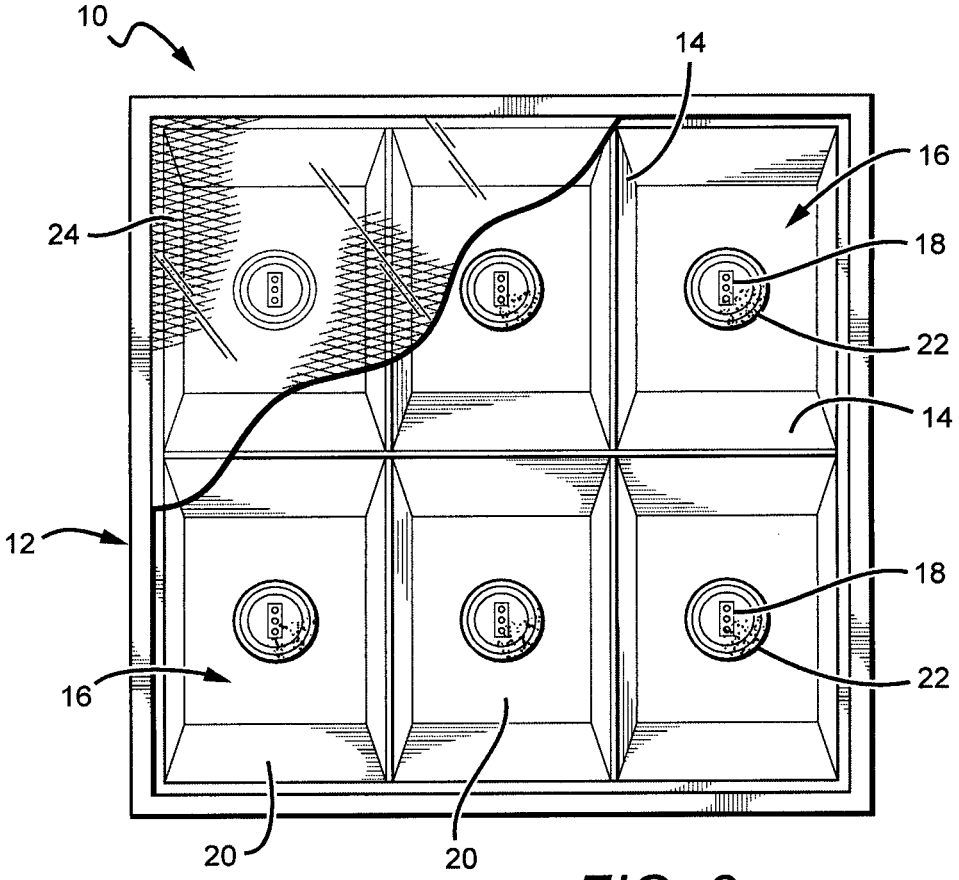
FIG. 3 is a top view of the lighting fixture shown in FIG. 1, with a second diffuser.

The present invention is directed to light fixtures with the embodiments described herein directed to troffer-style fixtures that are particularly well-suited for use with solid state light sources, such as LEDs or LED packages. Instead of utilizing hundreds of LED packages in the light fixture that are driven by a relatively low drive signal, the fixtures according to the present invention can utilize LEDs, LED packages, LED arrays, etc., that are driven by a higher drive signal and emit higher light output (i.e. luminous flux). By utilizing high output emitters, the light fixtures according to the present invention utilize much fewer LEDs. This can result in lower costs and complexity for the fixtures not only for the LEDs and LED packages, but also for mounting and interconnecting the LEDs or packages.

Some of embodiments can utilize a plurality of LED arrays, with each mounted intermittently to the surface of a conventional troffer housing to emit light out of the troffer opening to illuminate the room below the troffer. Some of these embodiments can utilize LED arrays having discrete LEDs emitting the same color of light, while others can have different LEDs emitting different colors of light that can combine to produce the desired array emission as described in more detail below. To help reduce or eliminate emission hot spots and to help mix the different colors of LED light, different multiple lens and/or diffuser arrangements can be used according to the present invention. In some embodiments, a first lens or diffuser ("diffuser") can be mounted over each of the LED arrays, with the first diffuser having light scattering or dispersing properties. The first diffuser can work in conjunction with a second diffuser, and in some embodiments the second diffuser can comprise the conventional prismatic diffuser typically mounted over the troffer fixture opening. The first and second diffuser arrangement provide improved mixing or diffusion of the LED light, reducing hot spots and the visibility of the different colors in the array. It is understood that many different diffuser combinations are possible, and other embodiments diffuser arrangements can be utilized without the prismatic diffuser.

The present invention can also be used with many different types of lighting fixtures and housings, but are particularly applicable to troffer-style fixture of different sizes such as those having a 2 foot by 4 foot troffer opening. The embodiments of the present invention can also be used in troffer-fixtures having a 1 foot by 4 foot, or 2 foot by 2 foot troffer opening, or any other suitable dimension.

The invention is described herein with reference to certain embodiments, but it is understood that the invention can be embodied in many different forms and should not be construed as limited to the embodiments set forth herein. In particular, the present invention is described below in regards to troffer-style light fixtures, but it is understood that it is applicable to many other lighting styles, types and applications. The embodiments are also described with reference to diffusers, but it is understood that many different types and numbers of diffuser can be used that are arranged in many different ways. The fixtures can have LEDs or LED packages arranged in many different arrays having different shapes and different numbers of LEDs or LED packages. Many different commercially available LEDs can be used in the lighting fixtures according to the present invention such as those commercially available from Cree, Inc. These can include, but not limited to Cree's XLamp® XP-E LEDs or XLamp® XP-G LEDs.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. Thus, the term "source" should not be construed as a limitation indicating either a single-element or a multi-element configuration unless clearly stated otherwise. For example, the lighting fixtures described herein as having a solid state light source, can comprise light sources having a single-element or multi-element configuration.

Embodiments of the invention are described herein with reference to view illustrations. The actual thickness, angles or orientations of the elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of feature of an embodiment and are not intended to limit the scope of the invention.

FIGS. 1 through 4 show one embodiment of a light fixture 10 according to the present that can be used in many different applications, but in the embodiment shown comprises a troffer-styled light fixture sized to fit in, mounted to or suspended from ceilings, such as being mounted in a conventional ceiling "T-grid". The fixture 10 comprises a troffer pan/housing 12 sized to fit in or rest on the T-grid, with the housing 12 having a shape and size similar to the pans used for conventional fluorescent-type troffer lighting fixtures. The pan 12 can also comprise a plurality of reflective dividers 14 in a grid that divides the troffer fixture 10 opening into a plurality of fixture regions 16.

Each of the fixture regions 16 comprises a solid state light source 18 mounted to the bottom surface of the region 16. It is understood that many different light sources can be used that are arranged in many different ways, and in some embodiments the different regions can have different types of light sources. In some embodiments, each of the light sources 18 can emit light with the same characteristics, such as emission intensity, color temperature, and color rendering index. This can result in the particular fixture emitting a substantially uniform emission across its opening. The light sources 18 can be arranged with LEDs that can generate different colors of light, with the many industrial, commercial, and residential applications calling for fixtures emitting white lights.

In some embodiments, a multicolor source is used to produce the desired light emission, such as white light, and several colored light combinations can be used to yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source comprises combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to van de Ven et al.

Other light sources can comprise a series of clusters having two blue-shifted-yellow LEDs ("BSY") and a single red LED ("R"). BSY refers to a color created when blue LED light is wavelength-converted by a yellow phosphor. The resulting output is a yellow-green color that lies off the black body curve. BSY and red light, when properly mixed, combine to yield light having a "warm white" appearance. These and other color combinations are described in detail in the previously incorporated patents to van de Ven (U.S. Pat. Nos. 7,213,940 and 7,768,192). The light sources according to the present invention can use a series of clusters having two BSY LEDs and two red LEDs that can yield a warm white output when sufficiently mixed.

The light sources can be arranged to emit relatively even emission with different luminous flux, with some embodiments having light sources that combine to emit at least 100 lumens, while other embodiments can emit at least 200 lumens. In still other embodiments the lighting sources can be arranged to emit at least 500 lumens.

The surfaces of the fixture regions 16 can be reflective and can be arranged to reflect light from light sources 18 to illuminate the space below the fixture 10. In some embodiments, the surfaces can comprise a diffuse or reflective coating/layer 20 to help reflect and disperse light from the LED light source 18. In some embodiments, the layer 20 can comprise a white diffusive material such as a microcellular polyethylene terephthalate (MCPET) material or a commercially available DuPont/WhiteOptics material, for example. Other white diffuse reflective materials can also be used. In other embodiments, the coating/layer 20 can be textured or can comprise a specular or semi-specular coating, layer or surface.

Diffuse reflective coatings and layers have the inherent capability to mix light from solid state light sources having different spectra (i.e., different colors). These coatings are particularly well-suited for multi-source designs where two different spectra are mixed to produce a desired output color point. A diffuse reflective coating can reduce or eliminate the need for additional spatial color-mixing; although, embodiments according to the present invention comprise lenses or diffusers used in combination with diffuse reflective coating. In some embodiments, the surfaces can also be coated with a phosphor material that can convert the wavelength of at least some of the light from the light emitting diodes to achieve a light output of the desired color point.

In other embodiments the layer 20 can comprise materials other than diffuse reflectors. For example, in some embodiments the coating/layer 20 can comprise a specular reflective material or a material that is partially diffuse reflective and partially specular reflective. In some embodiments, it may be desirable to use a specular material in one area and a diffuse material in another area. These are only some of the many combinations that are possible.

The regions 16 and their reflective surfaces can have many different shapes and sizes and can comprise planar or curved reflective surfaces. The housing 12, regions 16 and reflective surfaces under the coating 20 can be made of many different materials, with a preferred material for at least some of these being heat conductive, such as a metal, to help in conducting and dissipating heat away from the light sources.

The fixture 10 can also comprise a plurality of first diffusers 22, each of which can be included over a respective one of the light sources 18, with some diffuser embodiments comprising scattering particles in a binder. Each diffuser 22 can be arranged to mix light emitted from its light source 18 and to reduce or eliminate the visibility of the discrete LEDs in the light source 18. Each diffuser 22 can be mounted in place using conventional adhesives or mounting devices, such as snaps or brackets. In some embodiments each diffuser 22 can comprise elements to scatter light from its light source with some embodiments having scattering particles mixed in a material such as glass or plastic. Different scattering particles can be used with some embodiments having scattering particles made alumina, silica, titania, titanium dioxide, or combinations thereof. Different diffusers can have different sizes of scattering particles with some embodiments having particle sizes ranging from 0.1 to 1.0 microns. The diffuser can take many different shapes, such as a generally cylindrical cup shape as shown, with tapered surfaces.

In some embodiments, the diffuser 22 can comprise a rigid material that is transparent to the light from the light source 18, and can comprise an additional layer or film of scattering material on the rigid material. The thicknesses of the films can be uniform across the diffuser 22 or can have different thicknesses, and can utilize different binder and particle materials. The layer or film can comprise many different material arranged in many different ways, and can be applied using conventional methods such as spraying. In some embodiments a binding material can be used with the scattering layer/film with can be an organic polymer, such as ethyl cellulose, nitrocellulose or poly(ethylene oxide) or an inorganic polymeric system, such as, silicone or ethyl polysilicate. In still other embodiments the binder can comprise an enamel.

Different embodiments of diffusers according to the present invention can comprise varying scattering properties along any surface, and for those having a scattering layer along any direction of the interior and exterior surfaces of the diffuser. The diffuser can comprise a transparent material (substrate) comprising a scattering film on it's inside surface having varying scattering properties. The scattering films can have many different thicknesses depending at least partially on the film/binder material used, type of scattering material, and the density of scattering material in the film. In some embodiments, the diffusers 22 can have a scattering film thickness ranging from 0.1 to 1000 microns, with the film being on the interior and/or exterior.

The fixture 10 can also comprise a system or mechanism to provide electrical power to the light sources 18 which can comprise a conventional power supply or ballast having various components and circuitry. Some of these can include an AC/DC converter and one or more DC/DC converters. Conventional power supplies can comprise large and costly components, and can also require setting of the output drive signal to provide the desired light engine light emission. The setting is typically done at the factory during light engine fabrication.

The troffer-style fixture 10 can also comprise a system or mechanism to distribute electrical power to the each light source 18. In the embodiment shown, a DC signal from an AC/DC converter can be distributed to the various light sources. The DC signal can be distributed in many different ways, such as through a wiring harness or through printed circuit boards (PCBs). The wiring harness or PCBs can run along different portions of the fixture and can have a connector arrangement for connecting to the electrical power to the light sources 18.

Each light source 18 can have its own DC/DC converter that can be on-board or adjacent the light source 18, that converts signal from the DC output to the appropriate DC level to drive the LEDs on the light source 18. Each of the DC/DC converters can have additional circuitry to provide other functions, such as compensating and dimming circuitry. These are only a couple of the many functions that can be provided along with the DC/DC converter.

Having respective DC/DC converters at each light source 18 can provide certain advantages. In conventional troffers having the AC/DC and DC/DC converters in one power supply can require setting of the output of the power supply at the factory to match it to the light engine of the particular troffer. Thus, if this type of combined power supply malfunctions or fails it can result in complex repair procedures or replacement of the entire troffer or light engine. By having the DC/DC converter at each light source, the AC/DC converter does not need to be set at the factory. A failed or malfunctioning AC/DC converter can be easily replaced in the field. If an on-board DC/DC converter malfunctions or fails at the light source, the light source can be removed and replaced with a functioning lighting source. The DC/DC converter on the light source will have been set to the desired level for that particular light source, so the repair procedure does not require resetting in the field.

Furthermore, the components for a combined AC/DC and DC/DC converters that drive the entire fixture can also be large and expensive. By making the DC/DC converter on-board and remote at each light source 18, smaller and less expensive components can be used because of the reduced power needed from each converter. A DC/DC converter for the entire fixture would need to accommodate 40 watts of power, or more. By dividing that load into multiple portions, the individual light source need only see 5 watts. This allows for many of the DC/DC circuit components to be consolidated into purpose-build integrated circuits, reducing cost and size. The remote DC/DC converters can also be arranged closer to the LEDs on each light source which can provide for greater driving efficiency and control.

Embodiments of the light fixture 10 according to the present invention can also comprise a second diffuser (shown in FIGS. 3 and 4) that works in conjunction with the first diffuser 22 to disperse and or mix light from the light source 18. The second diffuser 24 can be arranged in many different ways and in the embodiment shown covers the opening of the troffer housing 12 so that it covers each of the fixture regions 16. The second diffuser 24 can be made of the materials described above for the first diffuser, and can comprise scattering particles as described above. In other embodiments a surface of said second diffuser 24 can be textured, with some embodiments having a portion of the surface being textured and other embodiments having the entire surface textured. In still other embodiments the second diffuser can comprise a conventional prismatic lens/diffuser that is made of a material that is transparent to the light from the light source, and contains features to refract the light at different angles as it passes through. This refraction helps to disperse and mix light from the light source.

The combination of the first and second diffusers 22, 24 mixes light from light sources to reduce hot spots and reduce the visibility of different LED emission colors. This allows for a fixture with fewer high output light sources 10, with the fixture providing an even emission that is visually appealing to occupants of the room being illuminated. In some embodiments, light from each light source 18 can pass through first diffuser 22 and further mix and reflect before then passing through the second diffuser 24. This mixing and reflection can occur in many different ways with some embodiments arranged so that as least some light passing through the first diffuser 22 reflects off of the sidewalls of fixture region 16, and than passes through second diffuser 24.

Figure 5:
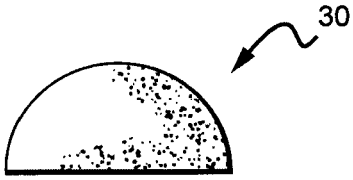
FIG. 5 is a side view of the hemispheric shaped first diffuser.
Figure 6:
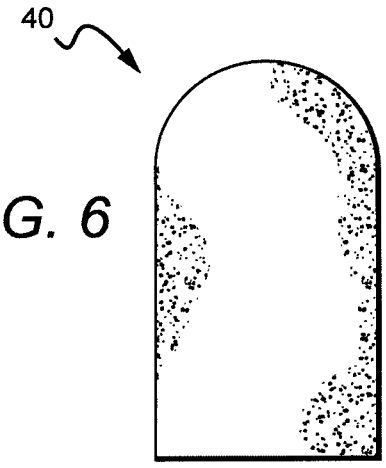
FIG. 6 is a side view a bullet shaped first diffuser.
Figure 7:
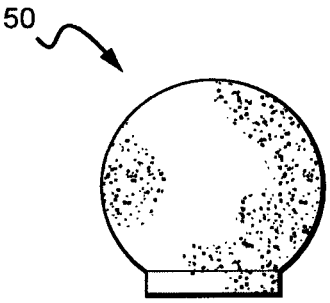
FIG. 7 is a side view of a globe shaped first diffuser.
Figure 4:
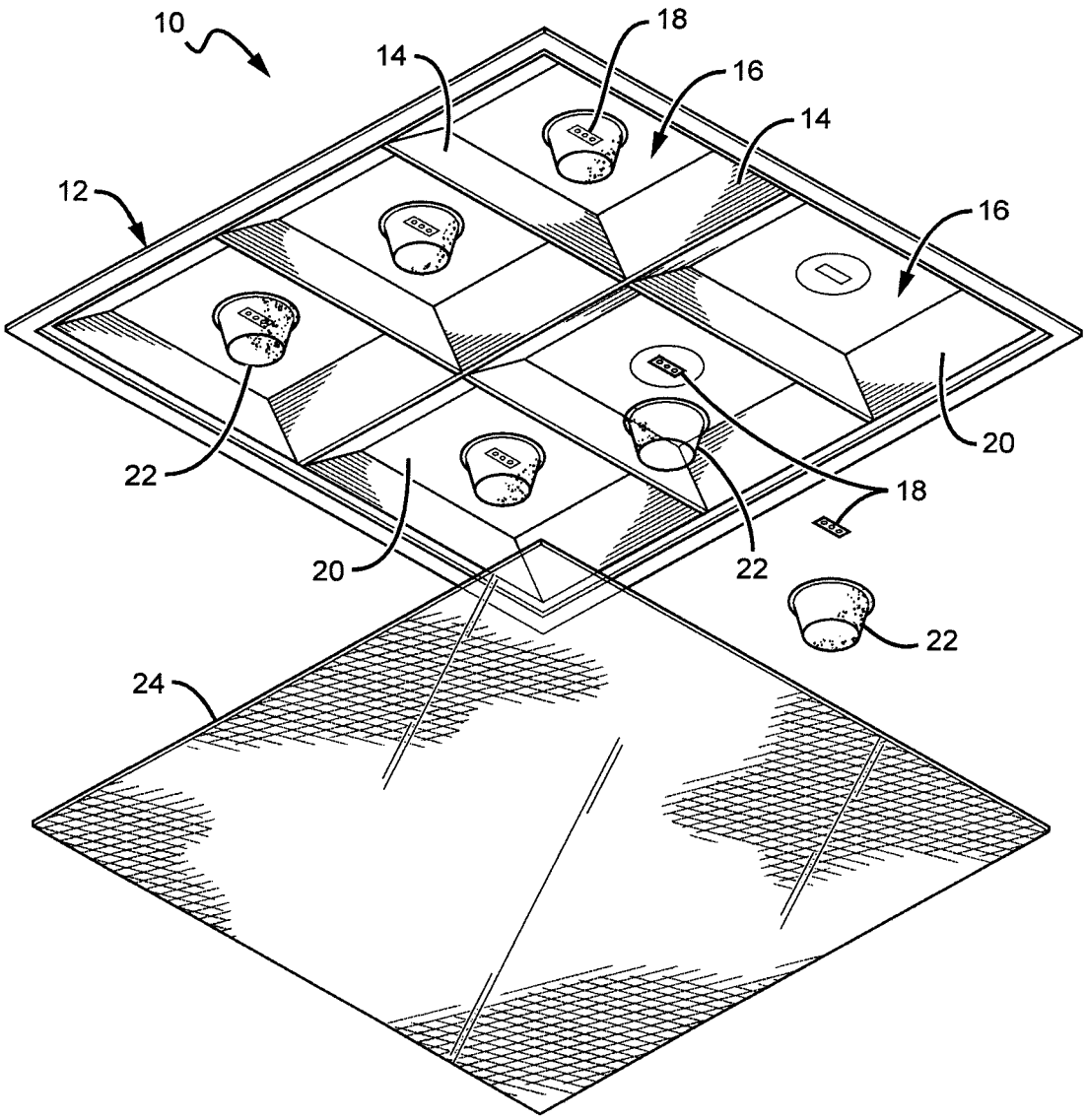
FIG. 4 is an exploded view of the lighting fixture shown in FIG. 3.

It is understood that the first and second diffusers 22, 24 can have many different shapes and sizes beyond those described above. The different shapes can be made of the same materials and can have the same or similar dispersing and mixing properties as the first diffuser 22 shown in FIGS. 1-4 and described above. FIGS. 5-7 show alternative embodiments for first diffusers according to the present invention, with FIG. 5 showing a hemispheric shaped diffuser 30, FIG. 6 showing a bullet shaped diffuser 40, and FIG. 7 showing a globe shaped diffuser 50. These are only a few examples of the many different shapes that the first diffuser can take, with other shapes including but not limited to square, rectangular, cylindrical, oval, etc. Each of these can be mounted in light fixtures according to the present invention, over a respective light source to provide the diffusing and mixing described above.

Figure 8:
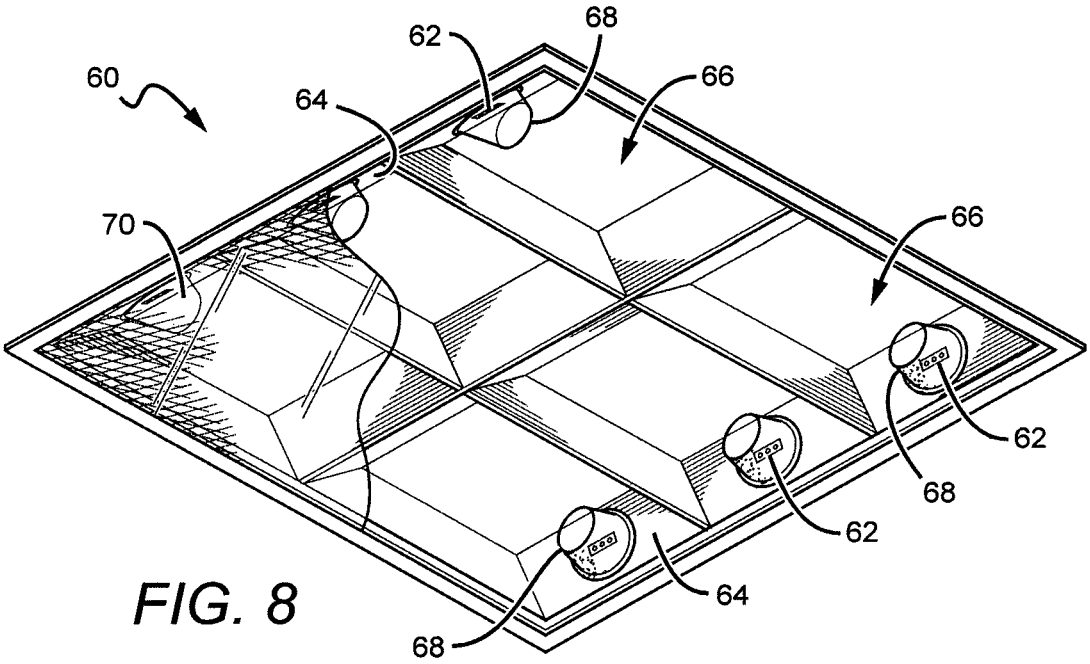
FIG. 8 is a perspective view of another embodiment of a lighting fixture according to the present invention.

Is it further understood that light fixtures according to the present invention can have light sources on many different ones of the reflective surfaces. FIG. 8 shows another embodiment of a light fixture 60 according to the present invention that is similar to the light fixture 10 shown in FIGS. 1-4, but has light sources 62 on the side surfaces 64 of the regions 66. The fixture 60 can also have first diffusers 68 over each of the light sources, with the diffuser similar to those described above. The fixture 60 can also have a second diffuser 70 similar to the ones described above, that in some embodiments can be a prismatic diffuser.

Figure 9:
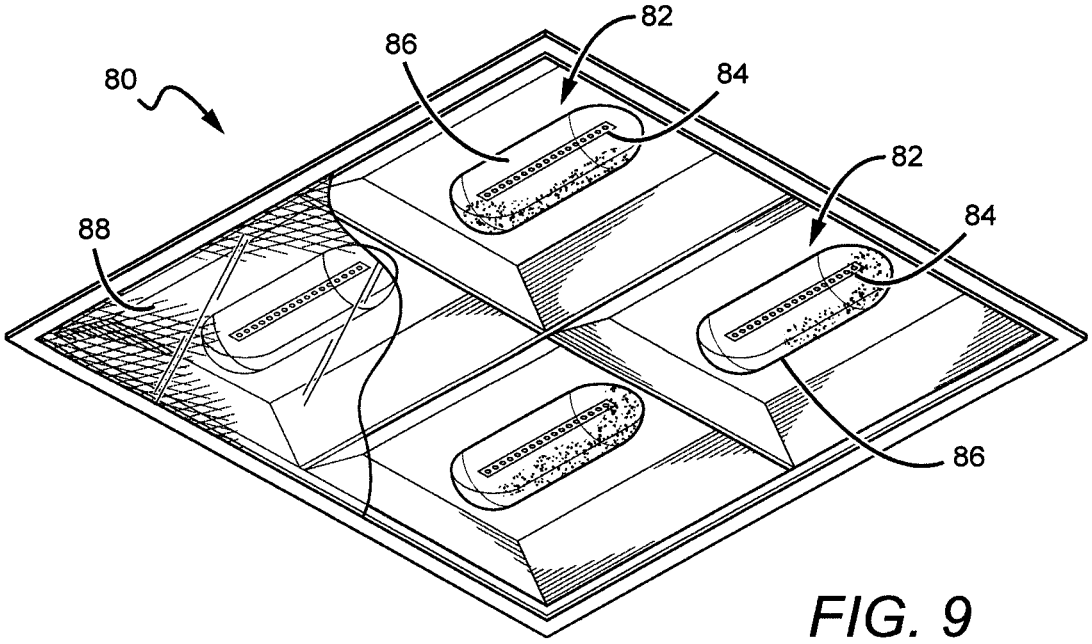
FIG. 9 is a perspective view of another embodiment of a lighting fixture according to the present invention.

Different light fixtures according to the present invention can also comprise different light sources and diffusers arranged in different ways, and the fixtures can have reflective regions arranged in different ways. FIG. 9 shows another embodiment of a light fixture 80 according to the present invention having a plurality four reflective regions 82, each of which has an elongated light source 84 comprising a plurality of LEDs. The light source 84 can comprise many different numbers of LEDs, with the embodiment shown having more than three LEDs. Each elongated light source 84 also has an elongated first diffuser 86 arranged over it, with the first diffuser 86 dispersing and mixing light from its light source 84 as described above. The light source can also comprise a second diffuser 88.

Figure 10:
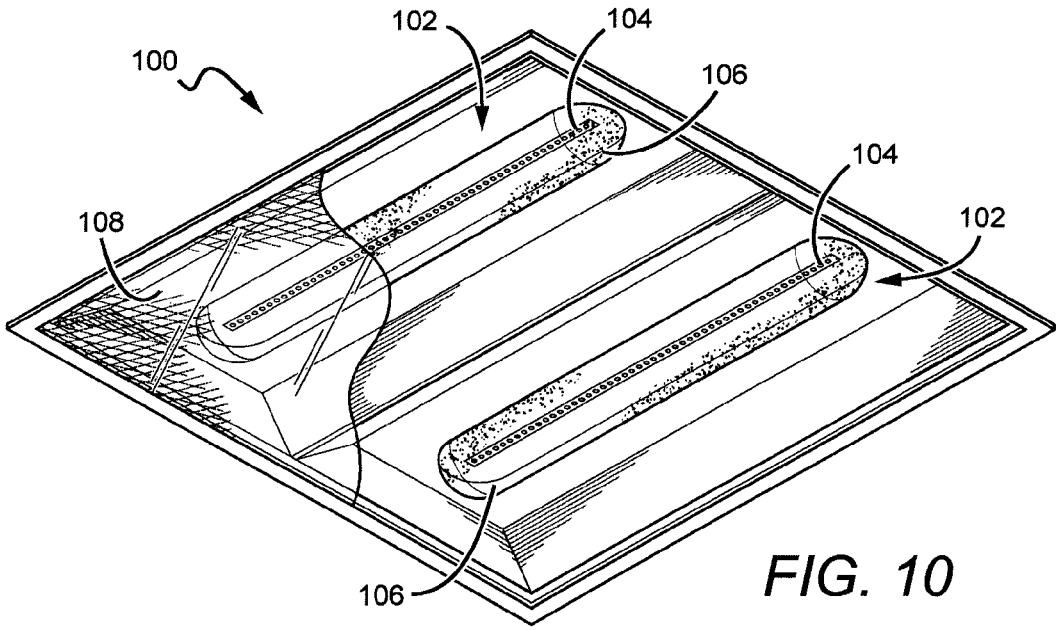
FIG. 10 is a perspective view of another embodiment of a lighting fixture according to the present invention.

FIG. 10 shows still another embodiment of a light fixture 100 according to the present invention has only two reflective regions 102, each of which has an elongated light source 104 comprising a plurality of LEDs. The light source 104 can comprise many different numbers of LEDs, with the embodiment shown having more than three LEDs. Each elongated light source 104 also has an elongated first diffuser 106 arranged over it, with the first diffuser 106 dispersing and mixing light from its light source 104 as described above. The light source can also comprise a second diffuser 108.

Figure 11:
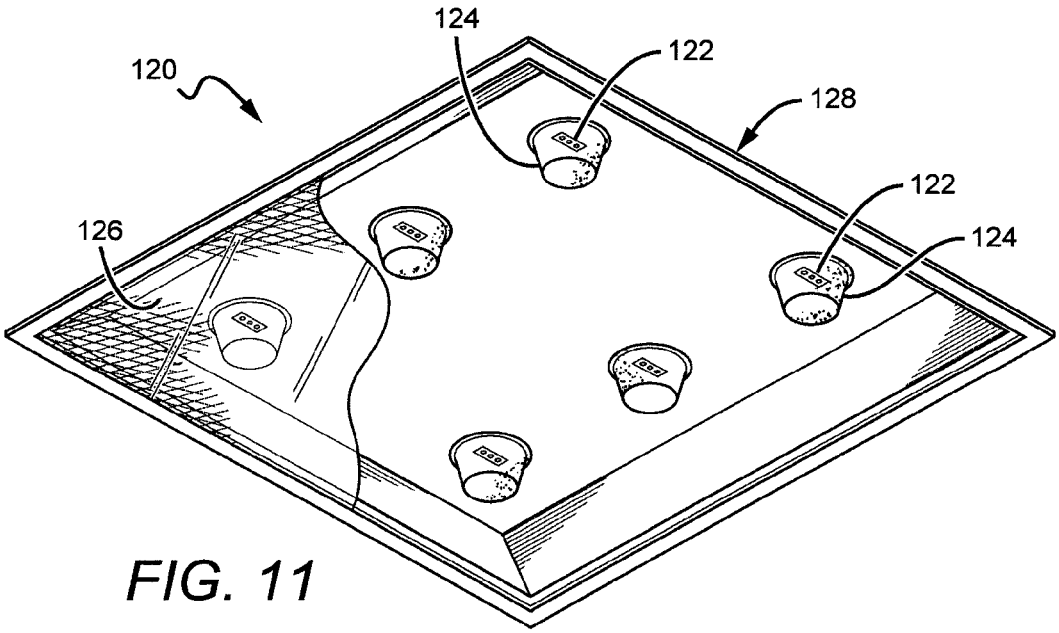
FIG. 11 is a perspective view of still another embodiment of a lighting fixture according to the present invention.

It is understood that the light fixtures according to the present invention can also be arranged without reflective regions and that some of these fixtures can be arranged with a conventional reflective frame. FIG. 11 shows still another embodiment of a light fixture 120 according to the present invention having light sources 122, first diffusers 124, and a second diffuser 126 similar to those shown in FIGS. 1-4 and described above. In this embodiment, there are no reflective regions between the light sources 122. It is understood that these embodiments could also be used with a conventional troffer-style reflective frame (not shown) that can be places over the troffer opening. In some embodiments, the reflective frame can be located in the troffer opening and supported directly by the ceiling's T-grid. In other embodiments, the reflective frame can be mounted to the troffer housing 128. In some embodiments one edge of the reflective frame can be mounted to the T-grid by a hinge. This allows for the frame to be rotated out of the T-grid opening about the hinge, to allow access to the elements of the fixture 120 from the room below.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

We claim:

1. A light fixture, comprising:

a fixture housing comprising a fixture opening;

at least three light emitting diode (LED) arrays mounted to said fixture housing, wherein at least two of said LED arrays are mounted to face substantially the same direction;

at least three first diffusers, each of said first diffusers over and at least partially surrounding at least one of said LED arrays, with each of said first diffusers dispersing and/or mixing light from its respective said LED array, wherein each of said first diffusers is mounted to said fixture housing, wherein a first and a second of said first diffusers are aligned in a first direction and said first and a third of said first diffusers are aligned in a second direction; and at least one second diffuser, wherein light from at least one of said LED arrays passes through said second diffuser after passing through its respective one of said first diffusers.

2. The light fixture of claim 1, wherein said second diffuser covers at least a portion of said light fixture opening.

3. The light fixture of claim 1, wherein said second diffuser disperses and/or mixes light from said LED arrays.

4. The light fixture of claim 1, further comprising a plurality of reflective regions, at least one of said LED arrays in each of the reflective regions.

5. The light fixture of claim 4, wherein at least one of said first diffusers is in each of said reflective regions.

6. The light fixture of claim 1, wherein each of said LED arrays emit white light.

7. The light fixture of claim 1, wherein each of said LED arrays comprises a blue-shifted-yellow LED and a red LED.

8. The light fixture of claim 1, wherein said first diffuser has a hemispheric, bullet or globe shape.

9. The light fixture of claim 1, wherein said first diffuser is cylindrical shaped with tapered side surfaces.

10. The light fixture of claim 1, comprising a troffer-style light fixture.

11. The light fixture of claim 1, wherein said second diffuser completely covers said light fixture opening.

12. The light fixture of claim 1, wherein said second diffuser is planar.

13. The light fixture of claim 1, wherein a surface of said second diffuser is textured.

14. The light fixture of claim 1, wherein said second diffuser comprises a prismatic lens/diffuser.

15. The light fixture of claim 1, wherein said dispersed and/or mixed LED light from said first diffuser further mixes and reflects in said fixture housing before passing through said second diffuser.

16. The light fixture of claim 15, wherein said fixture housing comprises reflective sidewalls, wherein said dispersed and/or mixed LED light from said first diffuser reflects from said reflective sidewalls before passing through said second diffuser.

17. A light fixture, comprising:

a fixture housing comprising a fixture opening;

a plurality of solid state light sources mounted to said fixture housing;

a plurality of diffusers, wherein at least two of said diffusers are mounted with the same orientation with relation to said fixture opening, wherein said plurality of diffusers at least partially surround said plurality of light sources, the light from said plurality of light sources passing through said plurality of diffusers prior to emitting from said fixture housing, said diffusers dispersing and/or mixing light from said solid state light sources, wherein each of said diffusers is mounted to said fixture housing, wherein a first and a second of said plurality of diffusers are aligned in a first direction and said first and a third of said plurality of diffusers are aligned in a second direction.

18. The light fixture of claim 17, wherein said solid state light sources comprise an array of light emitting diodes (LEDs).

19. The light fixture of claim 17, wherein said plurality of diffusers comprises a plurality of first diffusers, each of which is over a respective one of said solid state light sources.

20. The light fixture of claim 19, wherein each of said first diffusers has a similar shape.

21. The light fixture of claim 19, further comprising a planar second diffuser.

22. The light fixture of claim 21, wherein said second diffuser comprises a prismatic diffuser.

23. The light fixture of claim 17, further comprising a plurality of reflective regions, at least one of said solid state light sources in each of the reflective regions.

24. The light fixture of claim 17, wherein each of said solid state light sources emits white light.

25. The light fixture of claim 17, wherein said first diffusers have a cylindrical, hemispheric, bullet or globe shape.

26. The light fixture of claim 17, comprising a troffer-style light fixture.

27. A troffer-style light fixture, comprising:

a troffer housing, comprising a plurality of reflective regions;

a plurality of light emitting diode (LED) light sources emitting white light, a respective one of which is mounted to said troffer housing in one of said reflective regions, wherein at least two of said LED light sources are mounted with the same orientation in relation to said troffer housing;

a plurality of first diffusers each of which is over and at least partially surrounding a respective one of said LED light sources, wherein each of said first diffusers is mounted to said troffer housing, wherein said plurality of first diffusers is in a grid formation; and a second diffuser over said first diffusers, wherein light emitting from said fixture passes through said first and second diffuser for dispersing and/or mixing.

28. The troffer-style light fixture of claim 27, wherein each of said LED light sources comprises an LED array.

29. The troffer-style light fixture of claim 27, wherein each of said reflective regions comprises a diffuse reflective coating or layer.

30. The troffer-style light fixture of claim 27, wherein each of said reflective regions comprises a textured, diffuse, specular and semi-specular coating or layer.

31. The troffer-style light fixture of claim 27, wherein each of said first diffusers has a similar shape.

32. The troffer-style light fixture of claim 27, wherein said second diffuser is planar.

33. The troffer-style light fixture of claim 27, wherein said second diffuser comprises a prismatic diffuser.

34. The troffer-style light fixture of claim 27, sized to fit in a T-grad ceiling opening.

35. The troffer-style light fixture of claim 27, comprising an AC/DC converter providing a first DC signal to said light fixture and a plurality of DC/DC converters, each of which providing a second DC signal to a respective one of said LED light sources.

36. The troffer-style light fixture of claim 27, wherein said troffer housing has a troffer opening, said second diffuser in said troffer opening.

37. A light fixture, comprising:

a fixture housing comprising a fixture opening;

at least three light emitting diode (LED) arrays mounted to said fixture housing, wherein at least two of said LED arrays are mounted to face substantially the same direction;

at least three first diffusers, each of said first diffusers on and at least partially surrounding at least one of said LED arrays, with each of said diffusers dispersing and/or mixing light from its respective said LED array, wherein each of said first diffusers is mounted to said fixture housing, wherein said first diffusers are in a grid formation; and at least one second diffuser on each of said first diffusers so that light from at least one of said LED arrays passes through said second diffuser after passing through said first diffusers.

* * * * *